US006869922B1

(12) United States Patent
Mullane

(10) Patent No.: US 6,869,922 B1
(45) Date of Patent: Mar. 22, 2005

(54) CLEANING FORMULATION

(76) Inventor: Mark Gary Mullane, 10 South View, Portishead, North Somerset BS20 7DP (GB)

( * ) Notice: Subject to any disclaimer, the term of this patent is extended or adjusted under 35 U.S.C. 154(b) by 0 days.

(21) Appl. No.: 09/936,974

(22) PCT Filed: Mar. 17, 2000

(86) PCT No.: PCT/GB00/00945

§ 371 (c)(1),
(2), (4) Date: Jan. 23, 2002

(87) PCT Pub. No.: WO00/55286

PCT Pub. Date: Sep. 21, 2000

(30) Foreign Application Priority Data

Mar. 18, 1999 (GB) ..... 9906215
Feb. 23, 2000 (GB) ..... 0004124

(51) Int. Cl.[7] ..... C11D 17/00; C11D 3/20; C11D 11/00; C11D 3/395; C11D 3/386

(52) U.S. Cl. ..... 510/276; 510/278; 510/504; 510/505

(58) Field of Search ..... 510/276, 506, 510/499, 475, 320, 278, 279, 280, 281, 365, 417; 134/26, 27, 28, 29, 30

(56) References Cited

U.S. PATENT DOCUMENTS

| | | | | | |
|---|---|---|---|---|---|
| 3,901,727 | A | | 8/1975 | Loudas | 134/4 |
| 4,180,472 | A | * | 12/1979 | Mitchell et al. | 510/337 |
| 4,257,908 | A | | 3/1981 | Wixon | 252/135 |
| 4,599,116 | A | * | 7/1986 | King et al. | 134/2 |
| 5,192,461 | A | | 3/1993 | Tomaszewski et al. | 252/156 |
| 5,227,085 | A | * | 7/1993 | Motsenbocker | 510/372 |
| 5,252,243 | A | * | 10/1993 | Minns | 8/111 |
| 5,429,684 | A | * | 7/1995 | Osberghaus et al. | 510/280 |
| 5,494,611 | A | * | 2/1996 | Howe | 510/242 |
| 5,545,350 | A | * | 8/1996 | Baker et al. | 510/517 |
| 5,786,317 | A | | 7/1998 | Townsend | 510/278 |
| 5,797,986 | A | * | 8/1998 | Rolando et al. | 134/6 |
| 5,861,365 | A | | 1/1999 | Colurciello, Jr. et al. | 510/278 |
| 5,877,133 | A | * | 3/1999 | Good | 510/175 |
| 5,905,065 | A | * | 5/1999 | Scialla et al. | 510/280 |
| 5,929,007 | A | | 7/1999 | Feng | 510/197 |
| 5,948,743 | A | * | 9/1999 | Fonsny et al. | 510/280 |
| 6,013,614 | A | | 1/2000 | Mahdessian | 510/277 |
| 6,177,395 | B1 | * | 1/2001 | Silvaggi et al. | 510/278 |
| 6,326,344 | B1 | * | 12/2001 | Levitt | 510/278 |

FOREIGN PATENT DOCUMENTS

| | | | |
|---|---|---|---|
| DE | 4039348 A1 | 6/1992 | C11D/1/28 |
| GB | 2166153 A | 4/1986 | C11D/3/44 |
| WO | WO 86/04349 | 7/1986 | C11D/1/72 |
| WO | WO 94/07980 | 4/1994 | C11D/1/90 |
| WO | WO 95/16023 | 6/1995 | |
| WO | WO 00/63331 | 10/2000 | |

* cited by examiner

*Primary Examiner*—Gregory Webb
(74) *Attorney, Agent, or Firm*—Synnestvedt & Lechner LLP

(57) ABSTRACT

An alkaline, aqueous composition suitable for cleaning carpets and other surfaces, which composition comprises a) 0.1 to 50% w/w of a first cleaning agent; b) 0.1 to 20% w/w of a second cleaning agent; c) 0.1 to 10% w/w of a third cleaning agent; and d) 0.1 to 10% w/w of a surfactant and optionally minor amounts of additives, with the balance being made up of water. This formulation is preferably used in conjunction with a neutralizing solution. A method for cleaning carpets and other surfaces is also disclosed.

39 Claims, No Drawings

CLEANING FORMULATION

The present invention relates to an improved cleaning system. It is particularly applicable to cleaning carpets and upholstery. The invention includes a new method for cleaning; new cleaning apparatus; and new compositions for use in the method and apparatus.

It is important to keep carpets clean. Carpets help purify the environment by accumulating particulates and gases from the feet and footwear of the people who walk over them as well as from the surrounding atmosphere. Soiled carpets, however, are not aesthetically appealing and wear poorly. Left uncleaned, they will eventually release particulates and gases back into the air. In closed-circulation buildings, heavily-soiled carpets will cease to help clean the environment, and may become a source of air pollution that could contribute to health problems.

Carpet-cleaning and maintenance programmes have a direct impact on carpet appearance and performance. Proper cleaning and maintenance can therefore keep carpets looking new and beautiful, extend their lifespan and contribute to a healthier indoor environment. Additionally, modern carpets which have been pre-treated with soil- and stain-retardants require special treatment to clean them properly whilst maintaining their soil- and stain-resistance.

There are a number of known carpet-cleaning and maintenance routines: loose and fitted carpets may be cleaned in situ using powder-form products which are scattered onto the carpets and removed again under suction after a mechanical treatment.

So-called 'steam cleaning' is another method offered by many cleaning contractors, but this method tends to saturate the carpet, including the carpet backing, as steam condenses once in contact with the carpet. This and other aqueous treatments tend to leave the fabric being cleaned thoroughly wet. In the case of carpets or upholstery, this is a major disadvantage. For example, a wet carpet should not be walked on until it is dry, which also means that any furniture cannot be put back into position for many hours.

In addition, if the carpet backing gets wet, it can shrink and this shrinkage can be of an extent to pull a fitted carpet away from the wall, particularly in a large room.

Similar problems exist with other substrates to be cleaned, such as fabrics, which can shrink once they are thoroughly wet.

A widely-used, conventional method involves the application of a detergent solution to the carpet, followed by extraction of detergent plus soils. Detergents, however, only attack water-soluble dirt. Therefore, when water-insoluble materials, such as grease, are present in the carpet, organic solvents must separately be applied and extracted.

Although detergents and other cleaning agents have conventionally been employed as carpet cleaning agents, as currently applied they can be detrimental to carpet appearance. Conventional detergents and cleaning agents used in carpet cleaning are highly alkaline; their pH is generally at least about 10–12. Residues from these alkaline products tend to remain on the carpet after the cleaning process is complete. This is undesirable, because alkaline conditions can affect the colour and stability of some dyes used in carpet and upholstery fabrics. In addition, these alkaline deposits can cause the carpet to become dirtier quicker than would otherwise have been the case.

Such conventional cleaning agents may also contain optical brighteners and soil retardants. The repeated use of these cleaning agents can therefore also lead to build-up of soil retardant and optical brightener in the carpet or on its surface, which, together with alkaline deposits, also promote rapid resoiling and degradation of carpet fibre, particularly in the case of nylon, and also can cause carpet colour to fade due to enhanced UV sensitivity.

Accordingly, it is an object of the present invention to overcome or minimise some or all of the problems outlined above.

According to a first aspect of the present invention, there is therefore provided an alkaline, aqueous composition suitable for cleaning carpets, which composition comprises:

(i) 0.1 to 50% w/w of a first cleaning agent;

(ii) 0.1 to 20% w/w of a second cleaning agent;

(iii) 0.1 to 10% w/w of a third cleaning agent; and (iv) 0.1 to 10% w/w of a surfactant.

All weights expressed herein are based on the total weight of the total composition, unless stated otherwise.

The composition of the invention is preferably in the form of a finely-balanced solution but may also be a weak emulsion. As well as on carpets, textiles, furnishings and the like, the solution may also be used on other surfaces, such as metal, glass and the like.

The first cleaning agent is water-soluble and is preferably one that is a complexing agent for complexing metal ions, and may also act as an alkaline detergent builder and/or water softener. More preferably, it is a non-acidic cleaning agent.

The second cleaning agent is also water-soluble or miscible and is preferably a binding agent for binding together the other ingredients in the composition and/or for maintaining the other components of the formulation in aqueous solution, emulsion or dispersion and/or otherwise for coupling together the other components of the composition. More preferably, it is miscible with water to form an aqueous solution.

The third cleaning agent is preferably an organic solvent capable of acting as a solubiliser or dissolving agent for grease, fats and the like that, more preferably, is a liquid that is dispersible in the other components of the composition and/or is stable in aqueous conditions.

Therefore, the present invention preferably provides a water-based cleaning composition comprising:—

(a) 0.1 to 50% by weight of detergent builder and water softener;

(b) 0.1 to 20% by weight of coupling agent:

(c) 0.1 to 10% by weight of organic solvent:

(d) 0.1 to 10% surfactant; and, optionally, (e) minor amounts of additives the balance being water.

This formulation provides significantly improved grease and stain-removing properties, compared to known formulations. The main ingredients of the formulation having cleaning properties are components (a), (b). (c) and (d), as defined above.

Preferably, the cleaning composition further comprises one or more of the following additional components (additives), including:— a colouring agent, such as a dye;

a perfume;

a biocide, preservative or ant-septic; and/or an anti-static agent.

In the compositions of this invention, the conditions for two or more components may be satisfied by one ingredient.

Preferably, in the compositions of this invention, halogenated surfactants and solvents are not used. Halogenated surfactants tend to be expensive and halogenated solvents are not environmentally friendly. The present invention therefore further provides an alternative carpet cleaning formulation that avoids the use of these undesirable ingredients. Similarly, many prior art cleaning compositions incorporate ammonia, or ammonium or other nitrogen-based ingredients; these can also be avoided by using the composition of the present invention. Accordingly, the present invention further provides a cleaning composition that excludes one or more of: halogenated ingredients and nitrogen-based ingredients.

Preferably, the complexing agent, component (a), comprises one or more solid, water-soluble, inorganic or organic compounds having a pH greater than 7 and preferably such that the pH of the total composition is greater than 8, more preferably in the range of from 8 to 12, especially about 10. Such suitable alkaline compounds may be selected from:— aminopolycarboxylic acids;

nitrilotriacetic acid;

alkylene diamine derivatives of carboxylic acids, such as ethylene diamine diacetic acid and ethylene diamine tetra-acetic acid (EDTA); and phosphonates, such as pyrophosphoric acid and polyphosphoric acid;

and salts thereof, such as alkali or alkaline earth metal salts.

These lists are not intended to be limiting in any way and any member of this general class of reagent can be employed. However, preferred compositions of this invention are those that do not include silicates, which (in use) could leave deposits or scale on the surface to be cleaned. The concentration of component (a) is generally in the range of 0.1–50% by weight, with a preferred range of 1–10% w/w. A particularly preferred range is from 2 to 8% w/w.

In a particularly preferred embodiment, the complexing agent, component (a), comprises an inorganic complexing agent comprising one or more of pyrophosphoric acid and polyphosphoric acid; and salts thereof.

Preferably, the binding or coupling agent, component (b), comprises a liquid, water-soluble or miscibie, oxygenated organic solvent, such as one or more compounds selected from ethers, alcohols and esters, in particular, an ether of an alkylene glycol.

Suitable compounds for use as component (b) include:— an ether of ethylene glycol;

an ether of propylene glycol, such as dipropylene glycol monomethyl ether and/or propylene glycol N-butyl ether; and an aliphatic alcohol, such as a $C_1$–$C_6$, preferably $C_2$–$C_4$, alkanol, such as isopropyl alcohol and/or ethanol.

Especially preferred is when component (b) comprises as dipropylene glycol monomethyl ether and/or propylene glycol N-butyl ether, particularly a mixture thereof, more particularly in a ratio of from about 2–3:1, especially 70:30, respectively.

Typical concentrations for the binding/coupling agent range from 0.1%–20% by weight with a preferred range being between 1%–10% w/w and a particularly preferred concentration being 3 to 5% by weight.

Preferably, the organic solvent, component (c), is any organic liquid that has particular cleaning effect on grease and fats. It is therefore more preferably immiscible with water in the absence of a surfactant and may comprise a medium-chain hydrocarbon and/or a fatty add ester. For example, the organic solvent may comprise one or more compounds selected from:—

$C_9$ to $C_{15}$ linear aliphatic hydrocarbons, such as $C_9$ to $C_{15}$ low aromatic content kerosene;

$C_6$ to $C_{15}$ cyclo-aliphatic hydrocarbons;

fatty acid alkyl esters, such as $C_{16}$ to $C_{22}$ fatty acid alkyl esters, preferably, $C_{16}$–$C_{18}$ fatty acid ($C_1$–$C_4$)alkyl esters.

The above list of organic solvents is not intended to be limiting in any way. In principle, it is possible to use any non-toxic, organic solvent for this purpose where the solvent has the ability to dissolve grease and fats. Especially preferred is when component (c) comprises a non-flammable (under the conditions of use), odourless, water-stable medium chain organic compound, such as a fatty acid derivative, an alkanol eg isopropanol; a glycol or a dibasic ester. Most preferred is a fatty acid methyl ester.

The organic solvent is generally present in a concentration of 0.1–10% by weight with a preferred concentration range being 1% to 5% by weight and a particularly preferred concentration being from 1 to 3% w/w, such as about 2% w/w. More preferably, the amount of solvent is kept to the particularly preferred range for admixture with the lower ranges of surfactant. Higher amounts of the organic solvent will require higher amounts of surfactant, which would lead to the formation of an emulsion, rather than a solution. Such emulsions also form part of this invention but are not preferred over the solutions, in particular because the amount of surfactant required would tend to result in foam.

Preferably, the surfactant, component (d), comprises a liquid, water-soluble or miscible, low-foaming, non-ionic, anionic or amphoteric surfactant, particularly an emulsifying agent that enables the organic solvent, component (c), to mix with the other components of the composition, such as ethers of fatty alcohols eg an ethoxylated alcohol. However, there is a very wide range of known surfactants and. In principle, any of these can be employed, as suitable, given the particular formulation. In particular, the surfactant preferably has the ability to bring any soils from the surface to be cleaned into solution or admixture with the composition of the invention.

The surfactant is generally present in a concentration of 0.1–10% w/w with a preferred range being 16% w/w and a particularly preferred concentration being in the range of from 3 to 4% w/w, such as about 3.5% by weight. In any case, the amount of surfactant required is, at minimum, that sufficient to maintain component (c), such as a fatty acid methyl ester, in liquid dispersion in the composition.

It is also desirable to add a biocide, which may be selected from any known biocides suitable for the purpose. Typical examples are quaternary ammonium salts, such as benzalkonium chloride. The biocide may be present in an amount in the range of from 0 to 5% w/w, such as about 1 to 2% w/w. Benzalkonium chloride is also a suitable anti-static agent for use in the composition.

Furthermore, benzalkonium chloride, when present, may comprise the primary contributor to the pH of the solution. Accordingly, the amount of benzalkonium chloride present may be such as to result in a solution having a pH greater than 7 and preferably such that the pH of the total composition is greater than 8, more preferably in the range of from 8 to 12, especially about 10.

It is also preferable to add a dye and/or a perfume to improve the appearance and odour of the cleaning formulation. Such dyes and perfumes for the use in cleaners are well known to those skilled in the art and may be present in an amount in the range of from 0 to 3% w/w, such as about 0.1–0.2% w/w perfume and/or less than about 0.1% w/w, eg less than about 0.01% w/w, colouring agent.

In the formulations of the invention, unlike in some prior art formulations, viscosity control is not essential, although the viscosity of the solution tends to be low and of a similar order to that of water or slightly higher. The composition is made up to 100% with water. The amount of water therefore is preferably in the range of from about 60 to 90% w/w, such as in the range of from about 70 to about 80% w/w.

The composition may be presented in ready-to-use form or in the form of a liquid concentrate for dilution with an appropriate amount of water. Conveniently, the composition may be in the form of a liquid concentrate for dilution with, in the range of from, 1 part concentrate to 8 parts water, preferably in the range of from 2 to 6 parts, such as 4 parts water. The weight percentage ranges, at their broadest, expressed above are suitable for both concentrate and final, diluted solution. However, preferred, narrow ranges are generally expressed in terms of a concentrate, for dilution 1 part concentrate with 4 parts water. The pH of the concentrate is in the same range as that mentioned above with respect to the final solution.

Accordingly, the present invention further provides a liquid concentrate for dilution with water to provide an alkaline, aqueous composition suitable for cleaning carpets, which composition is as defined hereinabove.

There is also provided a method for the preparation of a solution or concentrate according to this invention, which method comprises mixing together components (a) to (c), together with the water and any suitable optional ingredients such as biocide, and thereafter adding to that mixture component (d) and any suitable optional ingredients such as orange terpenes.

In order to assist in the objective of reducing or ameliorating build-up of alkali on or in the carpet, an alkaline cleaning composition is preferably used in association with a neutralising composition, whereby the pH of the combined compositions (in use) is reduced to about neutral, as indicated eg using a standard litmus paper test. By 'about neutral' in this context is meant that the pH is in the range of from 5.5 to 8.5, but more preferably in the range of from 6.5 to 8, such as about 7.5 or slightly alkaline.

Therefore, according to a second aspect of the invention, there is provided a two part cleaning composition comprising:

(a) an alkaline cleaning composition, such as preferably a cleaning composition as defined hereinabove: and (b) a neutralising composition comprising an aqueous solution of a non-oxidising acid.

A wide variety of acids can be used in the neutralising composition, but preferably the non-oxidising acid comprises one or more compounds selected from mild or weak inorganic and organic acids. Preferred such adds are non-toxic, food or pharmaceutical-grade acids, for health and safety reasons. It is particularly preferred to use a nonoxidising, organic add whose alkali metal or alkaline earth metal salts are water-soluble. Suitable organic acids are therefore citric acid; acetic acid; succinic acid; tartaric acid; tannic acid; propionic acid; and glycolic acid. It is also possible to use certain inorganic acids, such as sulphamic acid. The pH of the neutralising solution is preferably in the range of from 1.5 to 3.5, such as about 2.

The acid is typically supplied as an aqueous solution of, say, one part by weight of acid in forty parts by weight of water. One part of this stock solution may then be further diluted with, in the range of from, 20 to 80 parts by water before use. That is to say, one liter of stock acid solution is diluted to give a final volume of from 20 to 80 liters. Preferably, the dilution ratio is in the range of from 1:40 to 70, more preferably about 1:60. Once diluted, the pH of the neutralising composition is preferably in the range of from 2.5 to 4.5, more preferably in the range of from about pH 3 to 4. For example, the pH of a neutralising composition diluted 1:40 is preferably about 3.

It is known to apply an aqueous dispersion of an alkaline cleaning agent to a carpet and mechanically to buff the carpet to cause dirt to transfer from the carpet to the buffing pad. It has now surprisingly been discovered that it is highly advantageous to soak the buffing pads in hot, neutralising composition immediately prior to buffing.

This improvement provides a number of advantages. First, as mentioned above, the acid in the neutralising composition tends to neutralise the alkaline cleaning composition on the carpet so that the carpet is left at a substantially neutral pH of 5.5–8.5 on completion of the cleaning process. This protects the dyes in the carpet from discolouration, and tends to reduce the rate of re-soiling and the degradation of carpet fibres.

Secondly, the temperature of the buffing pad is maintained, for the time it takes to apply neutralising solution to the carpet, well above ambient. The raised temperature of the buffing pad appears significantly to increase the rate and extent to which dirt is extracted from the carpet, believed to be as a result of enhanced capillary action causing the dirt to wick up the fibres.

Therefore, according to a third aspect of the invention, there is further provided a method suitable for cleaning carpet, upholstery or the like (referred to herein, collectively, as 'carpet'), which method comprises:—

(a) applying to the carpet an alkaline cleaning composition, such as preferably a cleaning composition as defined hereinabove, in an amount sufficient to wet the carpet fibres; and (b) mechanically buffing the carpet with a pad soaked in a neutralising composition comprising an aqueous solution of a non-oxidising acid in an amount sufficient to substantially neutralise the alkaline cleaning composition remaining on the carpet.

Preferably, the aqueous acidic solution is heated to a temperature in the range of from 50° to 95° C., more preferably in the range of from 70 to 85° C. prior to buffing the carpet, whereby the pad, after immersion in the neutralising composition, is in that temperature range when the buffing starts.

Preferably, the alkaline cleaning composition comprises a water-based cleaning composition as described herein. Preferably, the neutralising solution comprises an aqueous acidic solution as described herein. Accordingly, the method of the invention is most preferably carried out using the two-part cleaning composition of this invention. More preferably, the method is carried out in a manner whereby the ratio of neutralising solution to cleaning composition is greater than one, such as in the range of from 2 to 4:1, eg about 10:3, respectively.

Conveniently, doses of about 15 to 25 ml, such as about 18 to 22 ml, of the neutralising composition are applied, per pad, to the carpet. As a guide, about 10 liters of neutralising composition are required per 100 square meters of carpet.

Preferred pads for use in the method according to this invention are substantially flat, circular pads, comprising generally synthetic fibres sandwiching an absorbent layer. For example, they may comprise a polyester/rayon mixture that is capable of being in contact over its whole application face with the carpet, when in use.

Because the buffing pads have to be changed frequently, a special heating device has been developed to keep the pads both hot and saturated with acid solution. In its simplest form, this heating device comprises a liquid-tight tank, having a removable lid through which the pads can be inserted and withdrawn. The tank is conveniently heated by way of a thermostatically controlled heating element or the like, so that the temperature may be controlled between set temperature limits, as suggested above. The tank is constructed from any suitable material that is inert to the acid used. Typically, plastics materials or stainless steel can be used.

There are several desirable features that may optionally be incorporated into the tank. Because the pads are normally circular in shape, it is preferable that the lid to the tank and the access port are also circular. This facilitates inserting and removing the pads.

Because the pads may conveniently be kept immersed in the hot acidic solution whilst awaiting use and yet need to be accessible, preferably without having to delve too deeply into the acidic solution as each pad in turn is required, a spring-loaded dispenser, of the type used to store and dispense plates in a canteen, can be incorporated into the tank. This ensures that, however many pads are waiting in the tank, the top pad is always within easy reach. Alternatively, pads may be immersed in the neutralising composition, one-by-one, as required.

The tank is preferably adapted to be mounted on wheels, so that it can follow the buffing machine around the area to be cleaned. However, for convenience of storage, the wheels may be provided on a detachable trolley or wheel-base, separate from the body of the tank.

The following examples are provided for illustration of the invention only and are not intended to be limiting thereof.

EXAMPLE 1

Ready-to-Use Cleaning Composition

A water-based cleaning composition was prepared by mixing the following ingredients:—

| | % of total composition |
|---|---|
| Tetrapotassium pyrophosphate | 2.00 |
| Propylene glycol ether (DOWANOL DPM) | 2.95 |
| (C9 to C15) Aliphatic hydrocarbon (kerosene) (EXXOL D80) | 1.91 |
| Ethoxylated alcohol | 3.308 |
| Benzalkonium chloride (50% solution) | 0.092 |
| Dye/Perfume | Q/S |
| Water | Q/S to 100% |

EXAMPLE 2

Cleaning Composition Concentrate

An alkaline, aqueous composition suitable for dilution, prior to use, 1 part to 4 parts water, was prepared by mixing the following ingredients:—

| | % of total concentrate |
|---|---|
| Tetrapotassium pyrophosphate | 8.00 |
| Dipropylene glycol monomethyl ether | 3.50 |
| Propylene glycol N-butyl ether (DOWANOL PMB) | 1.50 |
| (C16–C18) Fatty acid methyl ester | 1.50 |
| Ethoxylated alcohol (SYNPERONIC 916) | 3.29 |
| Benzalkonium chloride (50% solution) | 1.536 |
| Dye | 0.0008 |
| Terpenes | 0.15 |
| Water | 80.3492 |

What is claimed is:

1. An alkaline, aqueous cleaning composition which comprises:

(a) 0.1 to 50% by weight of detergent builder selected from the group comprising pyrophosphoric acid and polyphosphoric acid and salts thereof;

(b) 0.1 to 20% by weight of a coupling agent consisting essentially of an oxygenated organic solvent;

(c) 0.1 to 10% by weight of a fatty acid alkyl ester and/or dibasic ester;

(d) 0.1 to 10% surfactant; and, optionally, (e) a minor amount of one or more additives.

2. A composition according to claim 1, further comprising one or more of the following additives: a colouring agent; a perfume; a biocide; a preservative; an anti-septic; and/or an anti-static agent.

3. A composition according to claim 1 further comprising benzalkonium chloride.

4. A composition according to claim 1, wherein component (b) consists essentially of a liquid, water-soluble oxygenated organic solvent.

5. A composition according to claim 1, wherein component (b) consists essentially of an ether of an alkylene glycol.

6. A composition according to claim 1, wherein component (b) consists essentially of a propylene glycol ether.

7. A composition according to claim 1, wherein component (c) consists essentially of a $C_{16}$ to $C_{22}$ fatty acid alkyl ester.

8. A composition according to claim 1, wherein component (c) consists essentially of a $C_{16}$–$C_{18}$ fatty acid ($C_1$–$C_4$) alkyl ester.

9. A composition according to claim 1, wherein component (d) consists essentially of a low-foaming surfactant capable of keeping component (c) in solution in the composition.

10. A composition according to claim 1, wherein component (d) consists essentially of an ether of a fatty alcohol.

11. A composition according to claim 1, wherein component (d) consists essentially of an ethoxylated alcohol.

12. A composition according to claim 1 in the form of a solution.

13. A composition according to claim 1, which is substantially free from halogenated surfactants and solvents; and/or ammonia; ammonium and other nitrogen-based ingredients; and/or silicates and other depositing inorganics.

14. A composition according to claim 1 having a pH in the range of from 8 to 12.

15. A composition according to claim 1 having a pH of 10.

16. A composition according to claim 1 comprising in the range of from 60 to 90% w/w water.

17. A concentrate composition suitable for dilution with, in the range of from, 1 to 8 parts water to prepare a composition according to claim 1.

18. A method for cleaning a surface which method comprises applying to the surface an alkaline cleaning composition as defined in claim 1, in an amount sufficient to wet the surface.

19. The use of a composition according to claim 1 in the preparation of an aqueous solution for cleaning a surface, such as carpet, upholstery, textiles, furnishings, metal and glass.

20. A method of preparing a composition according to claim 1, which method comprises bringing the components into intimate physical admixture to form an aqueous solution or weak emulsion.

21. An aqueous alkaline cleaning composition consisting essentially of:

(a) pyrophosphoric acid or polyphosphoric acid, or a salt thereof;

(b) an ether of an alkylene glycol;

(c) a $C_{16}$–$C_{22}$ fatty acid alkyl ester;

(d) an ether of a fatty alcohol; and optionally, (e) a colouring agent; perfume; biocide; preservative; anti-septic; and/or anti-static agent.

22. A two-part cleaning composition suitable for cleaning carpets, which composition comprises:

(a) an aqueous alkaline cleaning composition comprising (i) 0.1 to 50% by weight of detergent builder selected from the group comprising pyrophosphoric acid and salts thereof;

(ii) 0.1 to 20% by weight of coupling agent;

(iii) 0.1 to 10% by weight of fatty acid alkyl esters and/or dibasic esters;

(iv) 0.1 to 10% surfactant; and, optionally, (v) a minor amount of one or more additives; and (b) a neutralising composition;

whereby, in use, the pH of the combined compositions (a) and (b) is in the range of from 5.5 to 8.5.

23. A composition according to claim 22, wherein the alkaline cleaning composition (a) consists essentially of:

(i) pyrophosphoric acid or polyphosphoric acid, or a salt thereof;

(ii) an ether of an alkylene glycol;

(iii) a $C_{16}$–$C_{22}$ fatty acid alkyl ester;

(iv) an ether of a fatty alcohol; and optionally, (v) a colouring agent; perfume; biocide; preservative; anti-septic; and/or anti-static agent.

24. A two-part cleaning composition according to claim 23, wherein, in use, the pH of the combined compositions (a) and (b) is about 7.5.

25. A two-part cleaning composition according to claim 23, wherein the neutralising composition comprises an aqueous solution of a non-oxidising acid.

26. A two-part cleaning composition according to claim 23, wherein the neutralising composition (b) is in the form of an aqueous solution of one part acid to, in the range of from, 40 to 70 parts water.

27. A two-part cleaning composition according to claim 23, wherein the neutralising composition (b) is in the form of an aqueous solution of one part acid to 60 parts water.

28. A method suitable for cleaning a carpet surface, which method comprises:—

(a) applying to the surface an alkaline cleaning composition in an amount sufficient to wet the surface; and (b) mechanically buffing the surface with a pad soaked in a neutralising composition in an amount sufficient such that the pH of the combined compositions is in the range of from 5.5 to 8.5.

29. A method according to claim 28, wherein the neutralising composition is heated to a temperature in the range of from 50° to 95° C., prior to buffing the surface.

30. A method according to claim 28, wherein the neutralising composition is heated to a temperature in the range of from 70° to 85° C., prior to buffing the surface.

31. A method according to claim 28, wherein the alkaline cleaning composition comprises a water-based cleaning composition as defined in claim 1.

32. A method according to claim 28, using the two-part cleaning composition according to claim 22.

33. A method according to claim 28, in which the ratio of neutralising composition to cleaning composition is greater than one.

34. A method according to claim 28, in which the ratio of neutralising composition to cleaning composition is in the range of from 2 to 4:1, respectively.

35. A method according to claim 28, wherein the neutralising composition is heated in a tank prior to application to the surface.

36. A method according to claim 28, wherein the pad is heated prior to application to the surface.

37. A method according to claim 28, wherein the pad is heated by immersion in the neutralising composition prior to application to the surface.

38. A method according to claim 18, in which the surface being cleaned comprises carpet fibers.

39. A composition according to claim 6, wherein said propylene glycol ether consists essentially of propylene glycol N-butyl ether.

* * * * *